US007470226B1

(12) United States Patent
Herrin

(10) Patent No.: US 7,470,226 B1
(45) Date of Patent: Dec. 30, 2008

(54) APPARATUS AND METHOD FOR FORMING A CONTAINER HAVING AN ENHANCED CORNER SUPPORT STRUCTURE

(75) Inventor: Robert M Herrin, Orlando, FL (US)

(73) Assignee: R & L Manufacturing, Vero Beach, FL (US)

( * ) Notice: Subject to any disclaimer, the term of this patent is extended or adjusted under 35 U.S.C. 154(b) by 0 days.

(21) Appl. No.: 11/467,312

(22) Filed: Aug. 25, 2006

Related U.S. Application Data

(63) Continuation-in-part of application No. 10/721,962, filed on Nov. 25, 2003.

(60) Provisional application No. 60/711,277, filed on Aug. 25, 2005, provisional application No. 60/429,319, filed on Nov. 26, 2002.

(51) Int. Cl.
*B31B 1/48* (2006.01)

(52) U.S. Cl. ..... 493/143; 493/55; 493/125; 493/167; 493/177

(58) Field of Classification Search ..... 493/55, 493/143, 124–126, 167, 177–179
See application file for complete search history.

(56) References Cited

U.S. PATENT DOCUMENTS

| | | | |
|---|---|---|---|
| 2,665,836 | A | 1/1954 | Rendall |
| 3,978,774 | A | 9/1976 | Royal |
| 4,174,658 | A | 11/1979 | Graham |
| 4,256,025 | A | 3/1981 | Goda et al. |
| 4,289,491 | A | 9/1981 | Collura et al. |
| 4,418,863 | A | 12/1983 | Kimbrell, Sr. |
| 4,460,349 | A | 7/1984 | Charron |
| 4,500,306 | A | 2/1985 | Nowacki |
| 4,578,054 | A | 3/1986 | Herrin |
| 4,651,501 | A | 3/1987 | Matsuda et al. |
| 4,835,944 | A | 6/1989 | Herrin |
| 4,936,815 | A | 6/1990 | Kirkland et al. |
| 4,988,331 | A | 1/1991 | Boisseau |
| 5,024,641 | A | 6/1991 | Boisseau |
| 5,131,208 | A | 7/1992 | Paul et al. |
| 5,452,844 | A | 9/1995 | Bochet et al. |
| 5,782,732 | A | 7/1998 | Herrin |
| 5,797,716 | A | 8/1998 | Herrin |
| 5,807,223 | A | 9/1998 | Holton |
| 5,853,120 | A | 12/1998 | McLeod et al. |
| 5,916,078 | A | 6/1999 | Herrin |
| 5,971,906 | A | 10/1999 | Tharpe, Jr. et al. |
| 5,979,746 | A | 11/1999 | McLeod et al. |
| 6,226,965 | B1 | 5/2001 | Lam |
| 6,306,070 | B1 | 10/2001 | Herrin |
| 6,422,802 | B1 | 7/2002 | Herrin |
| 6,622,461 | B2 | 9/2003 | Gambetti |

*Primary Examiner*—Christopher Harmon
(74) *Attorney, Agent, or Firm*—Allen, Dyer, Doppelt, Milbrath & Gilchrist, P.A.

(57) ABSTRACT

An apparatus automatically forms a paperboard blank into a container having a double glued side wall construction for providing an enhanced strength to the container. A platen drives the blank through mechanically powered forming rails for an initial folding of the blank into a partially formed container having a bottom, end and side walls, and inside corner supports. A compression plate and folding arms are biased against adhesive portions of the partially formed container for forming a fully formed container having a double glued side wall construction.

9 Claims, 15 Drawing Sheets

FIG. 3
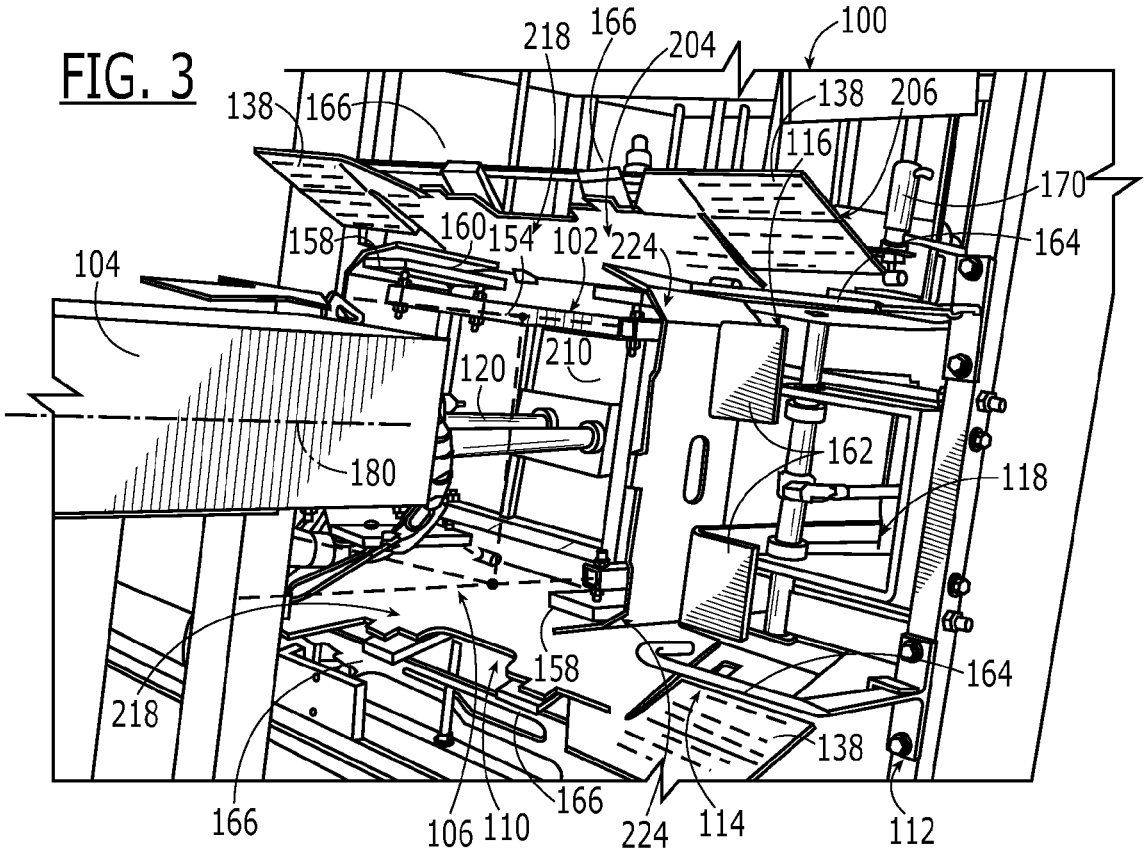
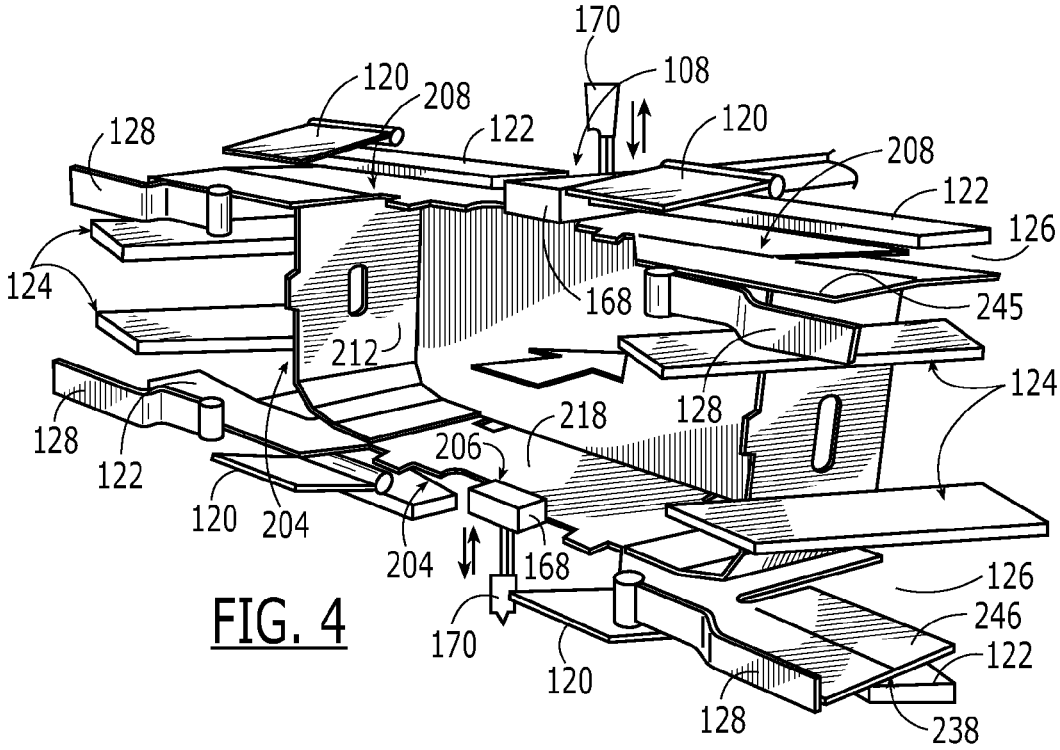
FIG. 4

APPARATUS AND METHOD FOR FORMING A CONTAINER HAVING AN ENHANCED CORNER SUPPORT STRUCTURE

CROSS REFERENCE TO RELATED APPLICATIONS

This application incorporates by reference and claims priority to application Ser. No. 60/711,277 FOR "Horizontal Feed Tray Forming Apparatus" having filing date Aug. 25, 2005 and to application Ser. No. 10/721,962 filed Nov. 25, 2003 for "Apparatus and Method for Forming a Double Glued Corner Tray Structure" which itself claims priority to application Ser. No. 60/429,319 filed Nov. 26, 2002 for "Tray Forming Apparatus And Method Of Forming A Double Glued Corner Tray Structure," all being commonly owned.

FIELD OF INVENTION

The present invention generally relates to container fabrication systems, and in particular to a container forming apparatus and automated method of forming a container from a scored paperboard blank, the container having a reinforced corner construction.

BACKGROUND OF THE INVENTION

It is well known in the art to use paperboard trays for stacking during delivery to a final destination such as a grocery store and for displaying products such as citrus within the tray as describe in U.S. Pat. No. 5,971,906 for a Tray Forming Apparatus and Method. Such trays are typically formed from a single blank which has been suitably cut, scored and perforated to be folded into a completed tray or container for subsequent filling of product and shipping. There remains a demand in the industry to strengthen the tray to overcome damage during stacking and delivery when carrying product, to reduce the time necessary to fabricate the tray, and as a result the associated costs.

By way of example, in an effort to strengthen such trays formed from a blank, a reinforced corner construction has been developed and is described in U.S. Pat. Nos. 5,853,120 and 5,979,746 to McLoud et al. which describe a container tray having corner reinforcing structures formed from a flat blank. While it is understood that reinforcing corners using multiple flaps or folds within the blank is desirable, it is also time consuming to fabricate such a structure. There remains a need to automatically form containers from flat blanks. There also remains a need to form containers, also herein referred to as trays, wherein the container is relatively deep having a side wall height or depth generally greater than its width, by way of example.

SUMMARY OF THE INVENTION

The present invention is directed to an apparatus and method for forming a blank into a tray having a reinforced corner construction. One embodiment of the apparatus may include a platen dimensioned for biasing against a blank and a platen drive for moving the platen between a first position proximate and in spaced relation to the blank and a second position through a biasing of the platen against the blank and a driving the blank downstream. A forming rail may be positioned downstream the first position for receiving the blank moving thereby and folding portions of the blank with a proximal portion of the forming rail partially folding peripheral portions of the blank and a distal portion of the forming rail securing the blank into a partially formed tray. A first folding arm is movably positioned for biasing against an extended portion of the partially formed tray. A compression plate is movably carried in spaced relation to the partially formed tray and a fixed plate may be carried in spaced relation to the compression plate so as to form a passage. A second folding arm is movably positioned for biasing against the extended portion of the partially formed tray and for folding the extended portion through the passage, with the first and second folding arms and the compression plate biased against the fully folded tray to cause an adhesion of corner portions of the tray and thus a fully formed tray having a double glued side wall construction.

By modifying the above apparatus to include a powered folding inside corner support member (also herein referred to as an end flap), an improved embodiment efficiently accommodates the forming of generally deep containers or trays. Improvements to the tray forming apparatus may include a power folding end flap mechanism, a power folding end panel mechanism, and an end flap device for controlling glue portions of the blank, which blank is fed into a forming area of the apparatus horizontally and flat.

An alternate embodiment of the apparatus and method is as generally described above, but with modifications that accommodate requirements for forming a deeper tray that will typically include an increased tray height when compared to the trays used for fruit, by way of example, and may typically use a light weight paper material. There is a need for a uniform fold to obtain a square tray. The increased tray height (depth) also adds to the stroke of the platen to desirably complete the folding. This increased stroke has a negative effect on the cycle time. To address these issues, the initial folding area includes forming rails movably powered folding mechanisms added in the initial folding process to fold up end flaps and thereafter fold the end panel to assist the platen. These two steps happen as the platen is engaged to move thru the folding area. Typically, this takes about 33% out of the platen stroke needed to typically make the initial folds earlier described.

Powering the movement of the end flaps and end panel, beyond simply allowing the platen to move the blank past fixed folding elements improves on the efficiency of the apparatus and permits the forming of relatively deep trays or containers, as will further detailed later in this specification. A design problem typically faced by those skilled in the art is how to get the paperboard blank into the forming area without impacting on the position of the flaps as it was being folded. Flaps must be folded in order of the process or a lock out of the flaps will occur. This is easily realized when one tries to fold the side panel and end flaps at the same time. The power folding features of the embodiment herein described by way of example solves this problem as the folding occurs upward before the side panels are moved. By way of further example, this removes restrictions of having a rail to (deliver the blank) in the folding area.

A method aspect of the invention may include providing a blank having portions thereof for forming a bottom panel, first and second opposing end panels, first and second opposing side panels, wherein each of the opposing end panels has an inside corner support member attached to opposing edges of each of the opposing end panels, each of the opposing side panels having a top wall portion attached thereto, and wherein an outside corner support member is attached to the top wall portion, the outside corner support member having an outside corner support and a side fold portion thereof for forming the blank into a tray having a double glued wall construction. The method may include biasing a platen against the bottom panel for moving the blank downstream through a forming rail positioned for folding the end panels and the side panels, wherein each inside corner support member is folded inwardly of the opposing side panels, further advancing the platen downstream and to a tray forming position, wherein a distal portion of the forming rail secures the blank into a partially formed tray. The partially formed tray may be configured with the end and side panels positioned generally orthogonal to the bottom panel and each of the inside corner support members are folded and in juxtaposition with the side panel portions, and wherein each of the top wall portions and outside corner support members are generally parallel to respective side panels. The platen is retracted from the tray forming position. A first folding arm may be biased against the top wall portion for folding the top wall portion to a position generally parallel to the bottom panel. The side fold portion may be partially folded by contacting a compression plate. A second folding arm may then be biased against each of the end fold portions for folding them into contact with the end wall. The compression plate is then biased against each of the side fold portions for forming a fully formed tray.

An alternate embodiment of the invention may comprise a platen movable between a first position and a second position along a path thereof, the platen operable for biasing against a blank positioned within the path and a driving of the blank downstream the first position toward the second position, first and second opposing edge rail pairs mechanically operable for inwardly folding outside portions of end panels of the blank while the platen is in the first position, the outside portions providing an inside corner support for a fully formed container, opposing first and second mechanically operable end folding rails positioned for receiving the end panels of the blank and for folding the end portions upwardly from a bottom panel of the blank, the platen being in the first position, and the outside portions of the end panels being inwardly folded, and opposing first and second side folding rails carried in a fixed position relative to and operable with the platen for receiving opposing side panels of the blank and for folding the opposing side panels upwardly from the bottom panel through a movement of the platen from the first position toward the second position so as to secure the outside portions of the end panels within their folded position.

An alternate method aspect of the invention may comprise providing a generally flat paperboard blank having a plurality of fold lines therein for defining a bottom panel, opposing end panels attached to the bottom panel via first fold lines, opposing side panels attached to the bottom panel via second fold lines, wherein each of the opposing end panels including an outside edge portion for forming an inside corner support member attached to opposing edges thereof via a third fold line, positioning the blank at a first forming position, supporting a platen proximate the first folding position in spaced relation to the blank, the platen dimensioned and aligned to fit proximate the first and second fold lines when contacting the bottom panel, providing first and second opposing edge rail pairs mechanically operable and positioned for folding the outside edge portions of the end panels, mechanically operating the first and second opposing edge rail pairs for folding the outside edge portions of the end panels along the third folding lines of the blank, providing opposing first and second mechanically operable end folding rails positioned for receiving end panels of the blank, mechanically operating the opposing first and second end folding rails for folding the end portions upwardly from the bottom panel along the first folding lines, the outside edge portions of the end panel already being inwardly folded, providing opposing first and second side folding rails carried in a fixed position relative to and operable with the platen for receiving the opposing side panels through an action of moving the platen downstream from the first position, biasing the platen against the bottom panel of the blank for advancing the blank downstream the first forming position for folding the opposing side panels upwardly from the bottom panel along the second folding lines, wherein an initial movement of the platen is sufficient for securing the outside portions of the end panels in a folded position through a biasing of the opposing side panels thereagainst, thus initially securing the outside portions of the end panels in the folded position prior to a further advancing of the platen further downstream, and further moving the platen downstream to partially form the container, wherein side walls of the container are generally perpendicular to the bottom panel.

An adhesive may be applied to a surface of the blank along each of the outside corner members and portions of the side panels proximate prior to moving the blank into the forming position. Alternatively, adhesive may be supplied with the blank.

BRIEF DESCRIPTION OF THE DRAWINGS AND PHOTOGRAPHS

A preferred embodiment of the invention, as well as alternate embodiments are described by way of example with reference to the accompanying drawings in which:

FIG. 3 is a partial front right perspective view of the apparatus of FIG. 1;

FIG. 4 is a partial top perspective view illustrating a partially formed tray positioned for folding elements thereof using associated folding elements of the apparatus of FIG. 1;

DETAILED DESCRIPTION OF THE PREFERRED EMBODIMENTS

Figure 1:
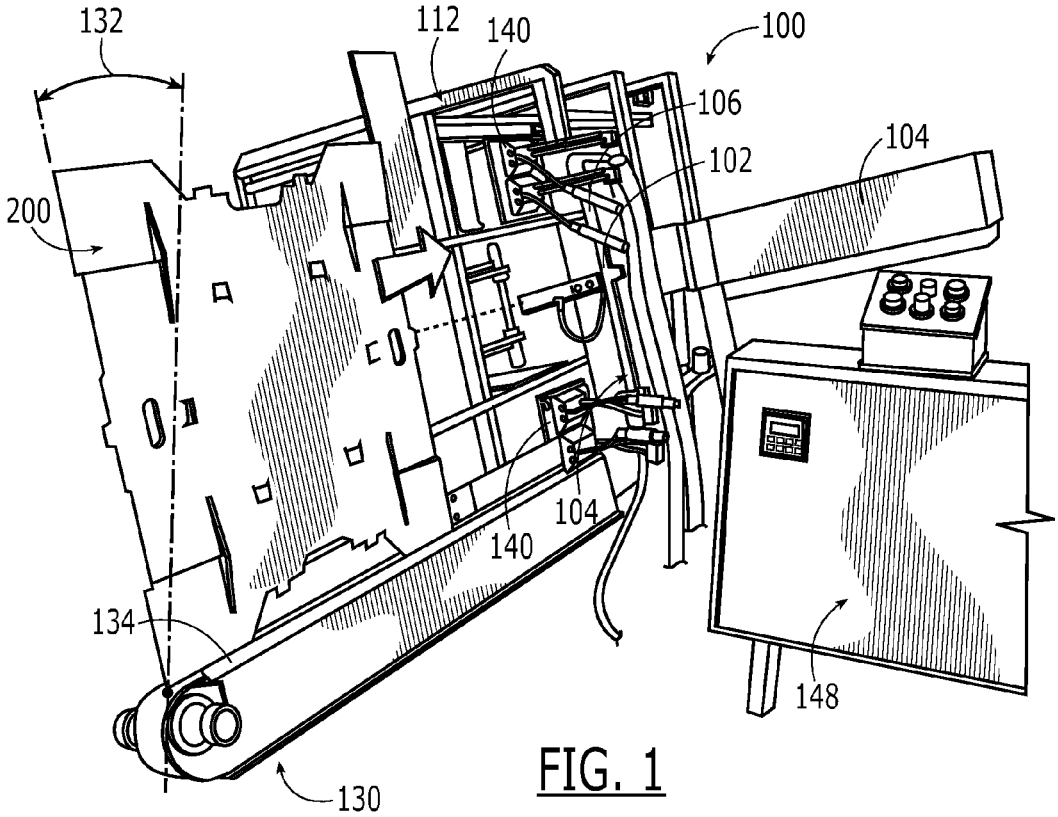
FIG. 1 is a partial front left perspective view of one tray forming apparatus in keep with the teachings of the present invention.

The present invention will now be described more fully hereinafter with reference to the accompanying drawings, in which embodiments of the invention are shown. This invention may, however, be embodied in many different forms and should not be construed as limited to the embodiments set forth herein. Rather, the embodiments herein presented are provided so that this disclosure will be thorough and complete, and will fully convey the scope of the invention to those skilled in the art. By way of example, and with reference initially to FIGS. 1 and 2, one embodiment of the present invention includes a tray forming apparatus 100 for forming a blank 200 into a fully formed tray 202. The apparatus 100 may further be described to include a platen 102 dimensioned for biasing against the blank 200 using a platen drive 104 operable for moving the platen between a first position 104 proximate and in spaced relation to the blank 200 and a second position 108, illustrated with reference again to FIG. 2, through an initial movement and biasing of the platen against the blank for driving the blank downstream the first position, as illustrated with reference to FIG. 3. As illustrated with continued reference to FIG. 1, a frame 112 carried the drive 104 as well as other forming elements and operable devices of the apparatus 100 later described in this section.

Figure 5:
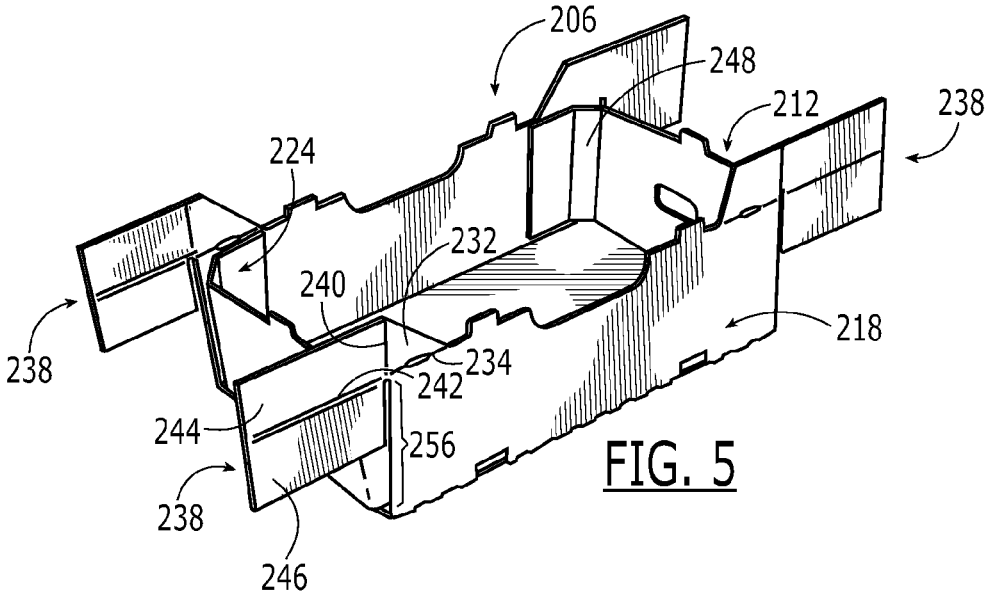
FIG. 5 is a top perspective view of the partially formed tray of FIG. 4.

With continued reference to FIG. 3, a forming rail is positioned downstream the first position 106 for receiving the blank 200 and folding peripheral portions 204 thereof, wherein a proximal portion 116 of the forming rail partially folds the peripheral portions of the blank and a distal portion 118 of the forming rail secures the blank as a partially formed tray 206, illustrated with reference to FIGS. 4 and 5, to be further detailed later in this section. With continued reference to FIG. 4, a first folding arm 120 is pivotally carried by the frame 112 and positioned for biasing against an extended portion 208 of the partially formed tray 206 for a folding thereof. A compression plate 122 is pivotally carried by the frame 112 and in a spaced relation to the partially formed tray 206. A fixed plate 124 is carried in a spaced relation to the compression plate 122 to form a passage 126, to be further detailed later in this section. A second folding arm 128 is carried by the frame 112 and positioned for pivoting and biasing against the extended portion 208 of the partially formed tray 206 for folding the extended portion through the passage 126.

With reference again to FIG. 1, an in-feed conveyor 130 may be used for conveying the blank 200 to the first position 106. BY way of example, one embodiment may include the conveyor 130 placing the blank 200 at an angle 132 to vertical, and thus in a non-vertical orientation for permitting gravity to slidably hold the blank against a surface of the conveyor while conveying the blank on a rotating belt 134. It is to be understood that the apparatus 100 may be operated with the blank entering at a horizontal orientation as well as the angle position herein described.

Figure 6:
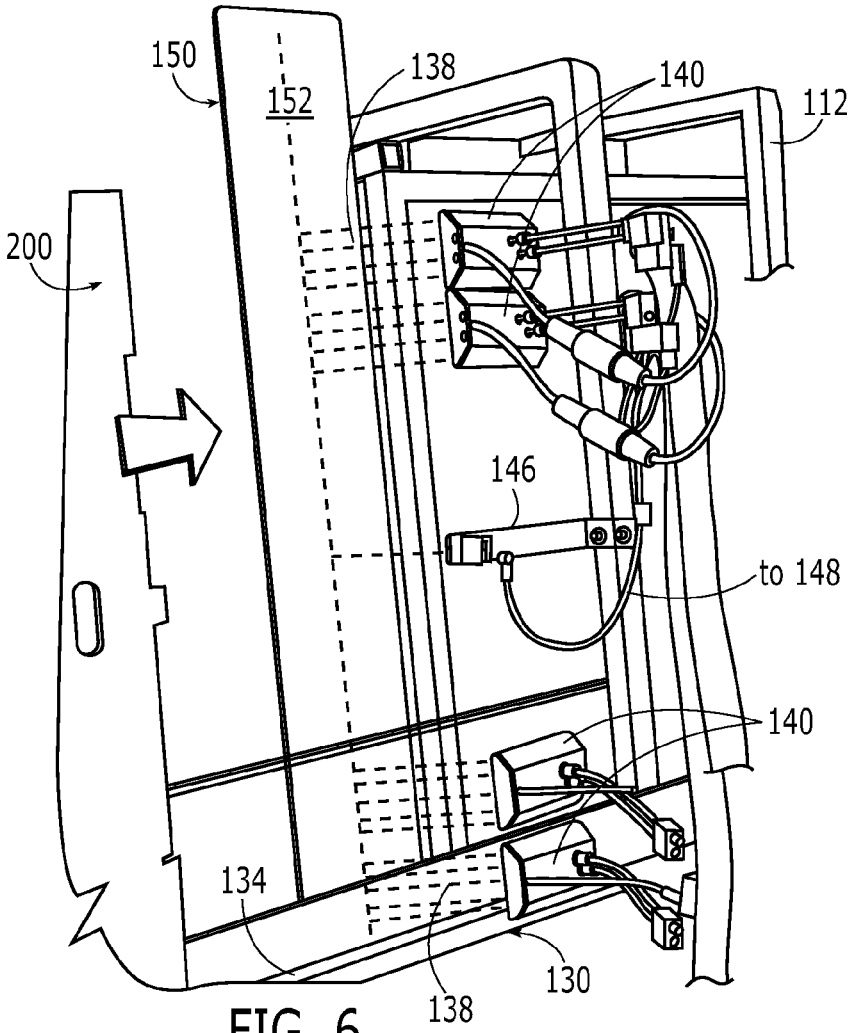
FIG. 6 is a partial enlarged front left perspective view of an adhesive application portion of the apparatus of FIG. 1.

With continued reference to FIG. 1, and to FIG. 6, the apparatus 100 herein described, by way of example, may include a hot glue applicator 136 for applying an adhesive 138 to the blank 200, as illustrated with reference to FIG. 7. In one embodiment, as herein described by way of example, multiple glue heads 140 may adjustably carried by the frame 112 for providing a specific spray pattern at a specific glue head temperature and thus a temperature of the glue for allowing the last surface to be glued to have a soft glue sufficient for making appropriate attachment as the first glued surface during the folding and compressing of the blank to form the tray. A sensor 146 is positioned for sensing a leading and a trailing edge of the blank 200 for providing a signal to a controller 148 for a timely directed allocation activation signal to allow the adhesive 138 to be applied as desired, such as illustrated with reference again to FIG. 7. With reference again to FIG. 6, the glue heads 140 are directed toward a backstop 150 having a roughened surface 152 for receiving any adhesive 138 that may miss hitting the blank 200. The roughened surface 152 allows any adhesive collected thereon to be easily removed when dry. It will be appreciated by those skilled in the art that alternate adhesive methods may be employed, now having the benefit of the teachings of the present invention. By way of example, stapling may be employed in conjunction with the various folding and biasing steps in forming the tray. Yet further, an adhesive may be carried by the blank that is responsive to temperature or pressure for activation. Similarly, various shaped blanks having various constructions may be used to form a container having a desirable shape, now given the teachings of the present invention.

Figure 7:
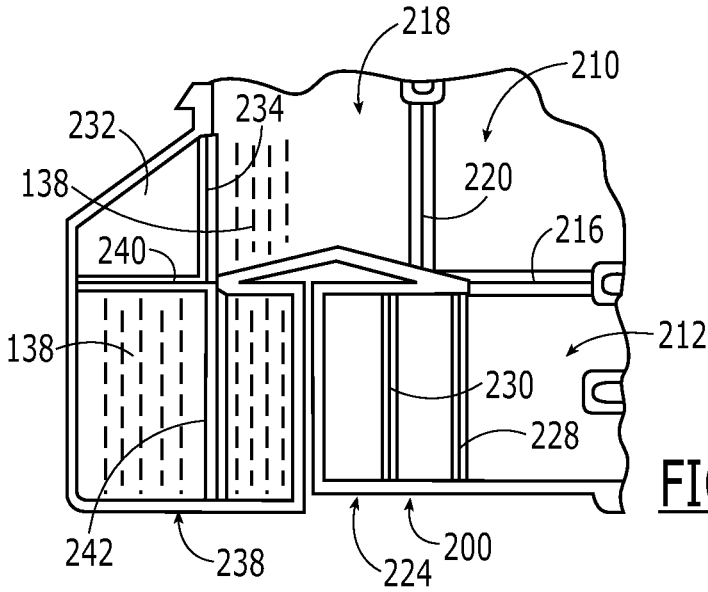
FIG. 7 is a partial plan view of a corner portion of the blank of FIG. 5 illustrating one embodiment of an adhesive applied thereto.
Figure 8:
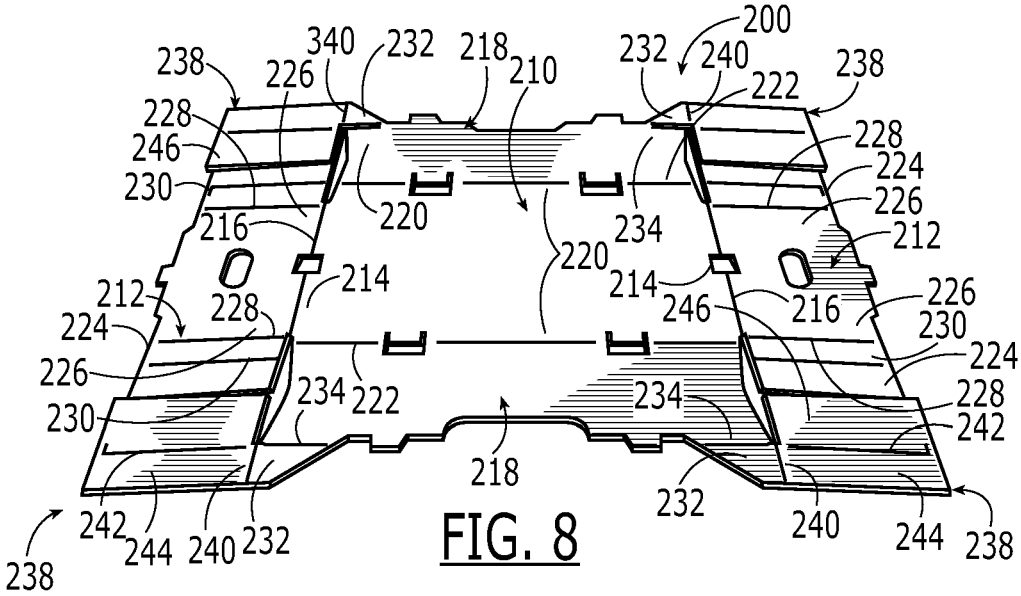
FIG. 8 is a top front perspective view of a paperboard blank having a plurality of fold lines and cuts for forming the blank into a tray through a plurality of folding operations.

To more fully describe aspects of the invention, the paperboard blank 200, as illustrated further with reference to FIG. 8 is herein described by way of example only. The blank 200 may be described to include a bottom panel 210 with first and second opposing end panels 212 formed at opposing peripheral end portions 214 of the bottom panel via first fold lines 216. First and second opposing side panels 218 are connected to opposing peripheral side portions 220 of the bottom panel 210 via second fold lines 222. An inside corner support member 224 is attached to opposing edges 226 of each of the opposing end panels 212 via a third fold line 228. In an optional construction, herein described by way of example, the inside corner support member 224 includes a fourth fold line 230 for forming a bevel within the tray construction. A top wall portion 232 is attached to opposing edges 234 of each opposing side panel 218 via a fifth fold line 236. Further for the blank 200 herein described by way of example, an outside corner support member 238 is attached to each of the top wall portions 232 via a sixth fold line, wherein the outside corner support member 238 includes a seventh fold line 242 for providing an outside corner support via an end fold portion 244 and a side fold portion 246. The above further illustrated with reference again to the single corner portion of FIG. 7.

Now having described the blank 200 more fully, embodiments of the apparatus 100 may be further described through detailed illustration. By way of example, and with reference again to FIG. 7, the platen 102 may comprise a rectangular peripheral portion dimensioned for folding the rectangular shaped bottom panel 210 of the blank 200 into a rectangular shape. In one embodiment of the blank 200, above described, the peripheral portion 154 of the platen 102 includes bevelled corners 156, as illustrated with reference again to FIG. 5, and to FIG. 9 to form the bevel 248 within the inside corner support member 224. The platen 102 is dimensioned and aligned to fit proximate the first and second fold lines 216, 222 when contacting the bottom panel 210. It is to be understood that while the inside corner support member is herein described by way of example as having a bevel portion, alternatively it may have a single fold to form a squared inside corner. It will be further understood that while the corner construction herein described in relation to the end panel and the side panel, the tray may be constructed in a mirror image or with reference to alternative end and side panels forming the tray.

Figure 9:
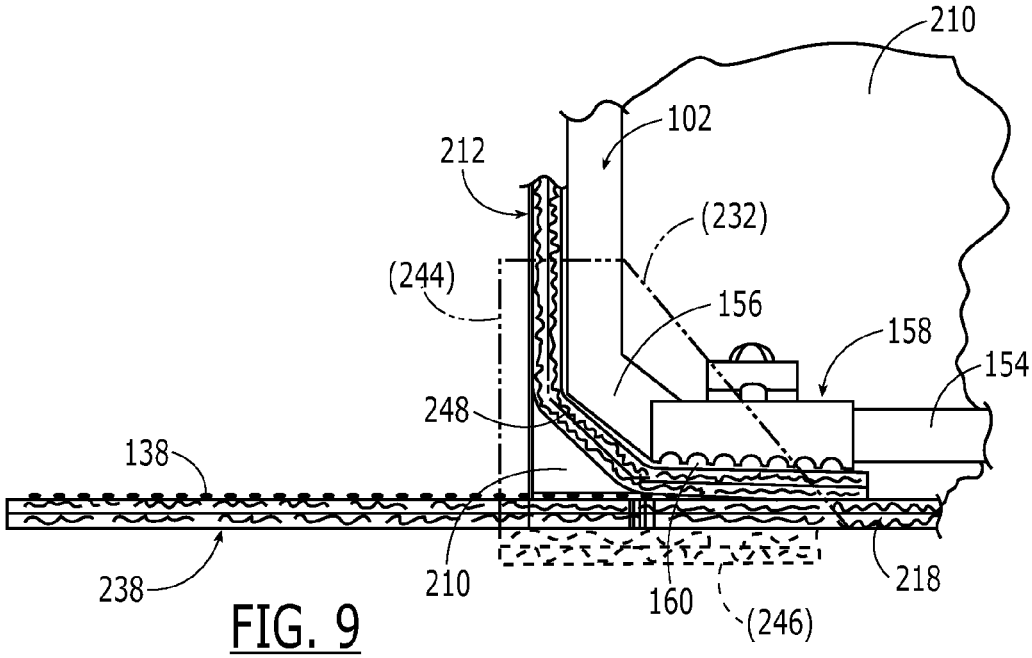
FIG. 9 is a partial top plan view of one corner portion of the partially formed tray of FIG. 5 illustrating one embodiment of a platen used to move the blank downstream through a portion of the tray forming process.

With continued reference to FIGS. 7 and 9, a guide plate 158 is carried by the platen 102 for further defining the platen peripheral portion 154 and for providing a compression surface 160 operable with the inside corner support member 224. The compression surface 160, as herein described by way of example, may comprise depressions for reducing a frictional contacting surface thereof. The corrugations on the compression side of the guide plates reduce the surface area for providing increased pressure on glue points while at the same time reducing friction between the guide plate surface and the tray inside wall to allow the platen to be more easily removed when being retracted, as earlier described.

By way of further example for the tray 202 herein desired, and with reference again to FIG. 3, the inside corner support member 224 is folded to about 90° while the side panel 218 is folded upward approximately 30°-45°. Next the end panel 212 is folded up approximately 90° and the side panel 218 is brought up to a 90° fold compressing the side panel, having the adhesive 138 thereon, against the inside corner support member 224 having the guide plate 158 against it. As a result, the rectangular structure of this sample tray is formed. Each guide plate 158 may includes adjustment screws for aligning the guide plate and positioning the corrugated surface 160 of the guide plate for a desired attitude when compressing varying styled trays. As a result an adjustable platen is provided Again using the blank 200, by way of example to more fully describe elements of the embodiment herein presented, reference is again made to FIG. 3 wherein the forming rail 114 may include opposing end folding rails 162 positioned for receiving the end panels 212 and dimensioned for upwardly folding them from the bottom panel 210. Opposing edge rails 164 are positioned for inwardly folding outside edge portions, the inside corner support members 224, herein described by way of example. Opposing side folding rails 166 are positioned for receiving the side panels 218 of the blank 200 and for folding the side panels upwardly from the bottom panel 210 while capturing the inside corner support members 224 therebetween. As earlier described, the blank 200 is received at proximal portions 116 of the forming rail 114, and a distal portion 118 thereof secures the now partially formed tray 206. The forming rail 114 folds the end panels 212 about the first fold lines 216 and the side panels 218 about the second fold lines 222, with each inside corner support member 224 folded about the third fold line 228 inwardly of the opposing side panels 218. The partially formed tray 206 is configured with the end panels 212 and the side panels 218 positioned generally orthogonal to the bottom panel 210 and each of the inside corner support members 224 folded about the third fold line 228 and in juxtaposition with the side panel, as illustrated with reference again to FIGS. 5 and 9. Each of the top wall portions 232 and the outside corner support members 238 are generally parallel to respective side panels 218 thereof.

With reference again to FIG. 4, a locking arm 168 is operable with the folding rail described with reference to FIG. 3 for securing the partially formed tray 206 at the second position 108, herein shown separately for clarity.

Figure 10:
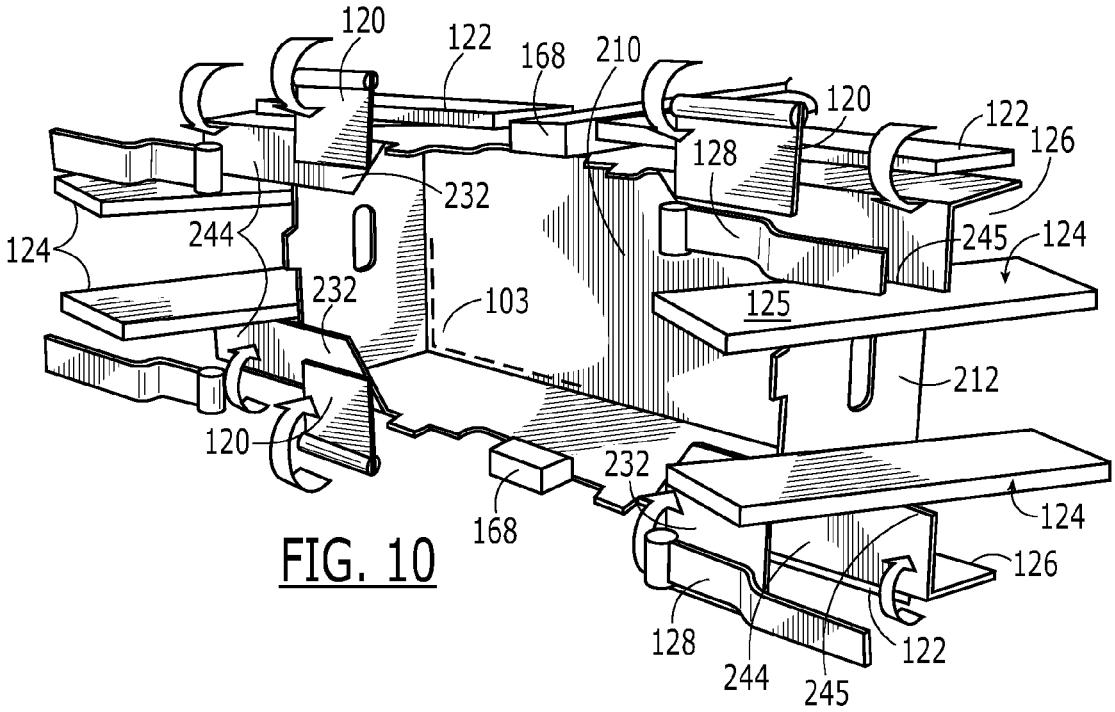
FIG. 10 is a partial perspective view illustrating a first folding arm operable on the partially formed tray.
Figure 11:
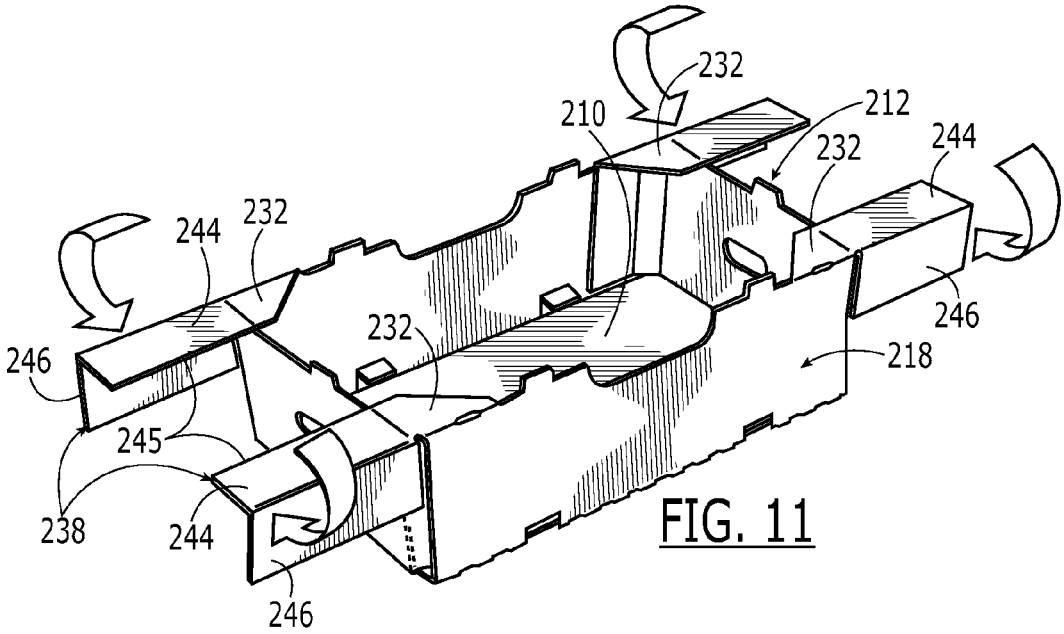
FIG. 11 is a top perspective view of the partially formed tray resulting from the folding process of FIG. 10.
Figure 12:
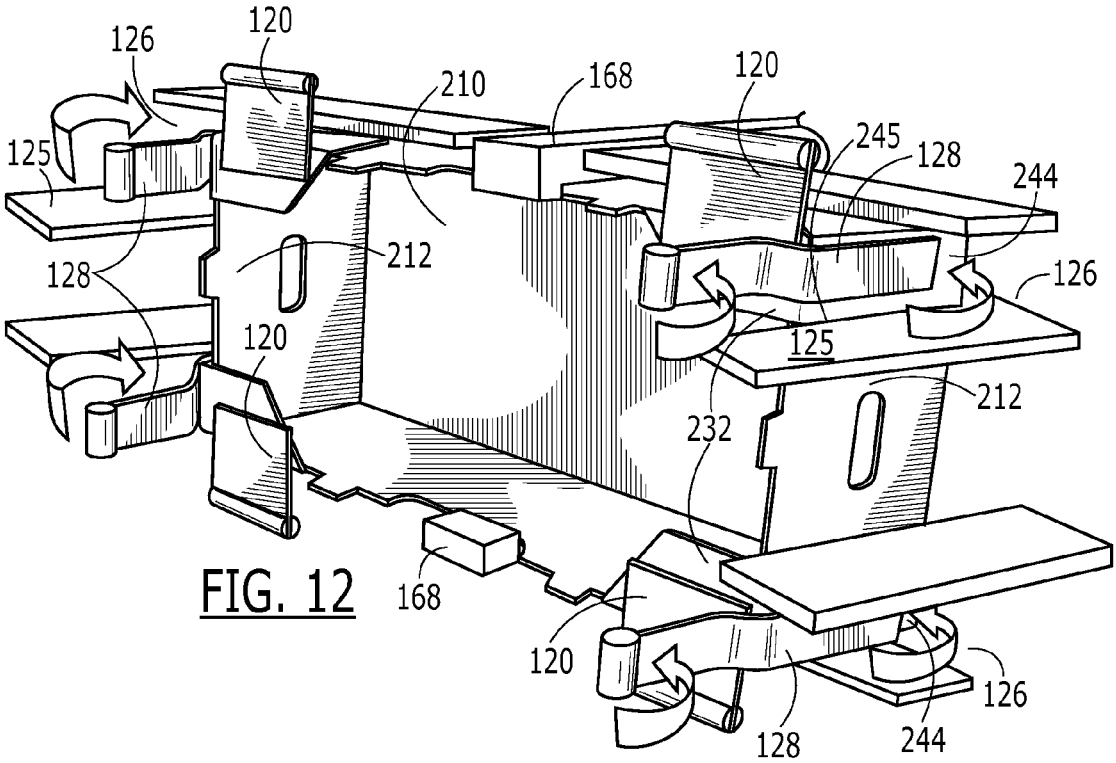
FIG. 12 is a partial top perspective view illustrating elements of the apparatus of FIG. 1 securing a fully formed tray therein.
Figure 13:
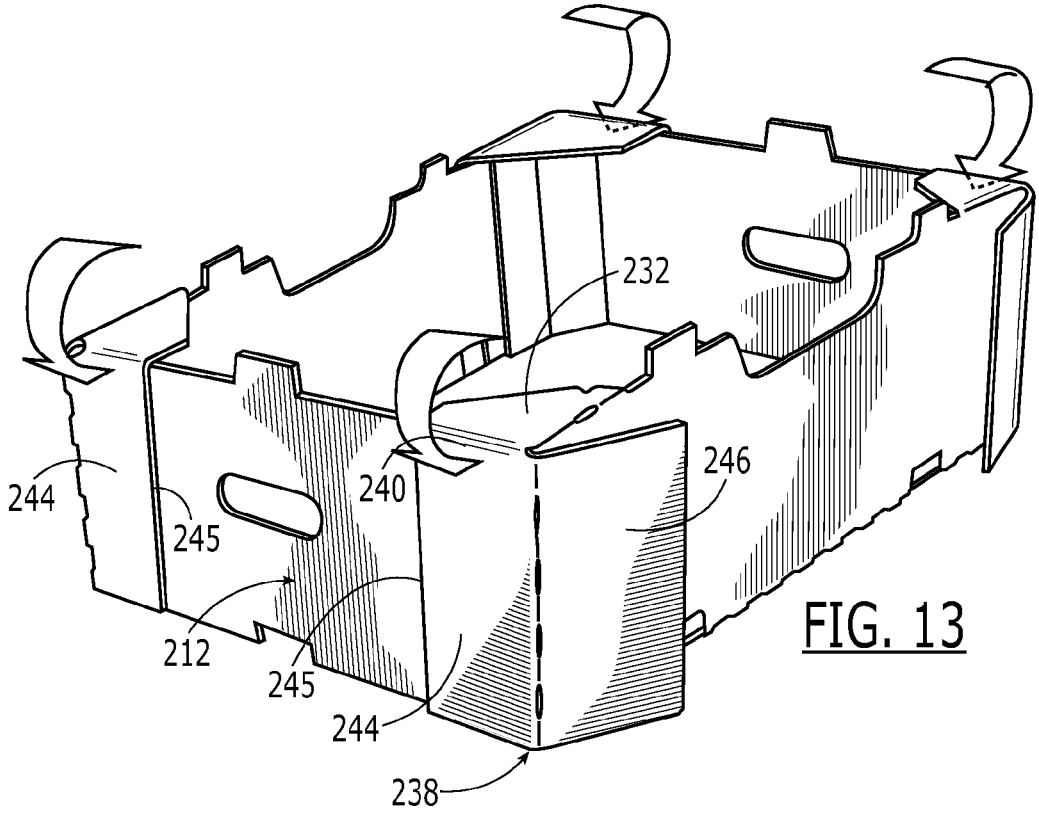
FIG. 13 is a top perspective view of the partially formed tray resulting from the folding process of FIG. 12.
Figure 14:
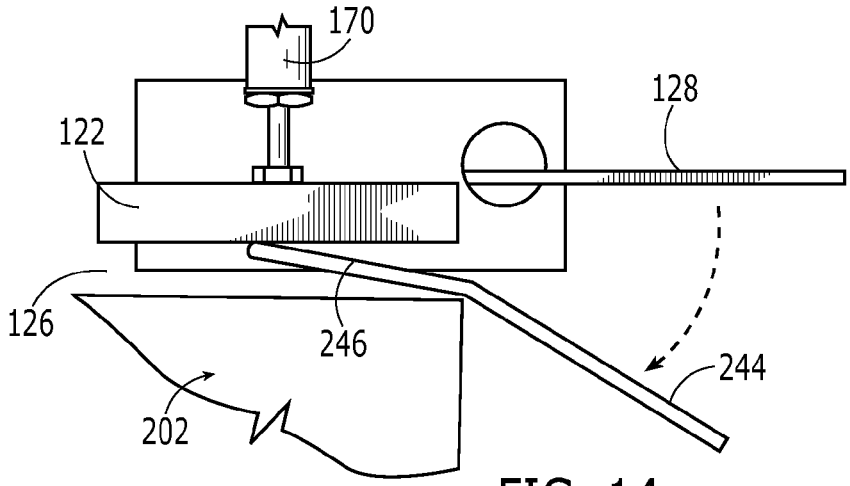
FIG. 14 is a partial perspective view illustrating a first folding arm operable on the partially formed tray.
Figure 15:
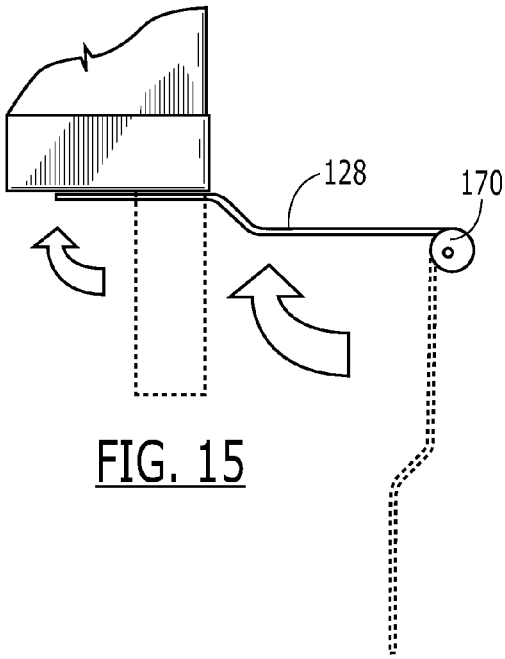
FIG. 15 is a partial perspective view illustrating a second folding arm operable on the partially formed tray.

With the partially formed tray 206 secured in the second position 108, as illustrated with reference again to FIG. 4, by way of example, the platen 102 is retracted and the folding of the top wall portions 232 and the outside corner support members 238 commence. With reference again to FIG. 2, and to FIGS. 10 and 11, the first folding arm 120 is operable for folding the top wall portion 232 about the fifth fold line 236 to a position generally parallel to the bottom panel 210. The side fold portion 246 is partially folded about the sixth fold line 240 by passing through the passage 126 formed by the spaced compressed compression plate 122 and the fixed plate 124. As earlier described, the compression plates 122 are moveable for biasing against each of the side fold portions 246. A squared inside corner is illustrated by way of example in FIG. 10, wherein a squared corner platen 103 would be employed.

For the double-glued corner construction, herein described, the partial folding of the side fold portion 246 has been shown to improve on the performance and speed in the forming process. The fixed plate 124 allows the outside corner support member 238 to stay oriented relative to a plane of the top wall portion 232 resulting in a "squared off" corner construction with vertical walls providing a desired strength needed during stacking of filled trays. By way of example, damage to fruit is avoided especially for the lower trays in the stack. It is to be understood that while the compression plate as herein described is used for both a guide plate to form the passage and a compression plate during movement thereof, alternatively a separate compression plate may be used in conjunction with a separate passage.

Figure 16:
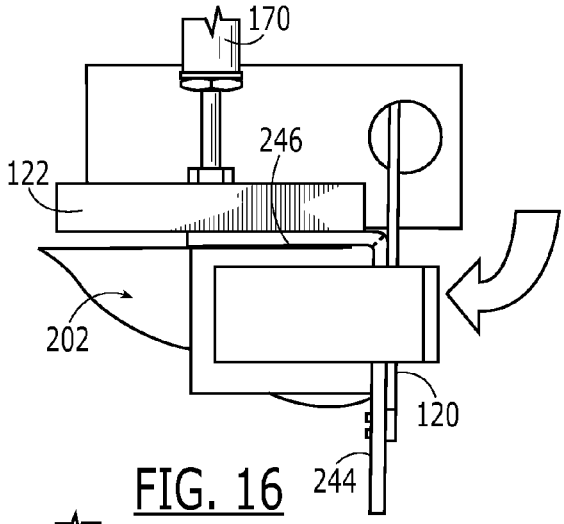
FIG. 16 is a partial end view illustrating an orientation of a compression plate and a first folding arm prior to a folding movement thereby.
Figure 17:
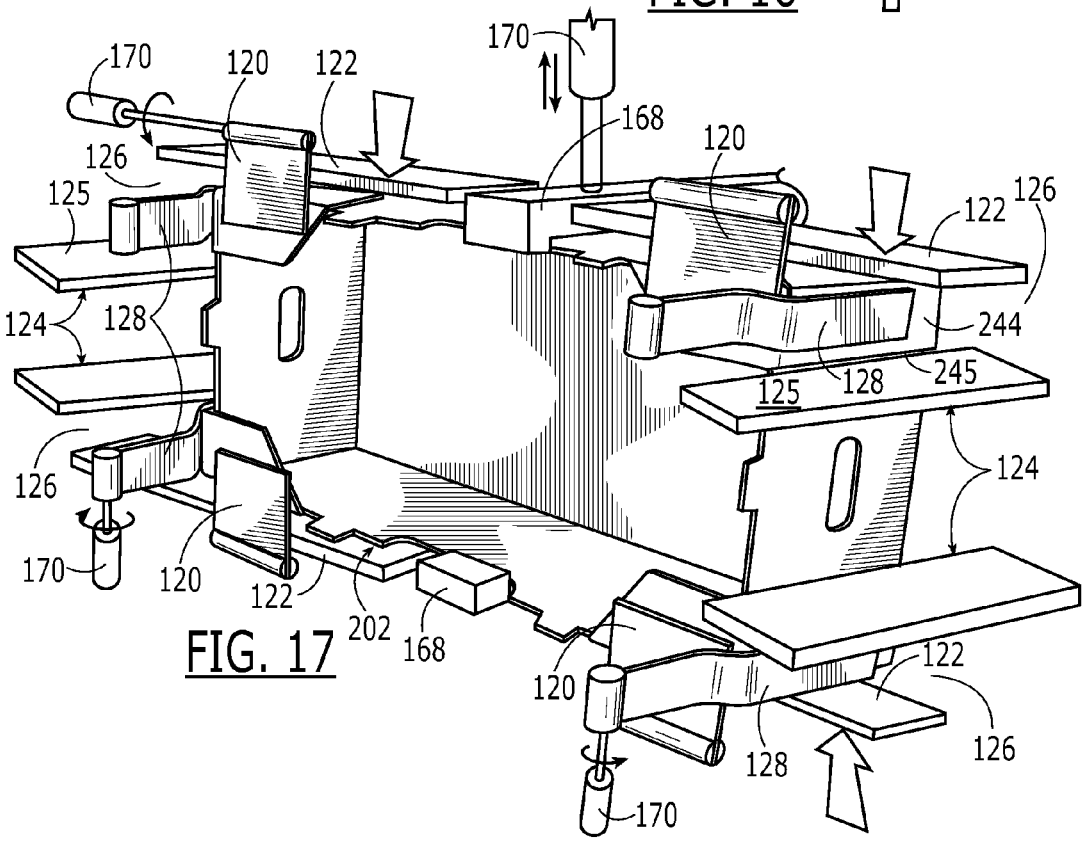
FIG. 17 is a partial perspective view illustrating an orientation of the compression plate, the first folding arm and the second folding arm is a compression orientation for holding corner portions of a fully formed tray.
Figure 18:
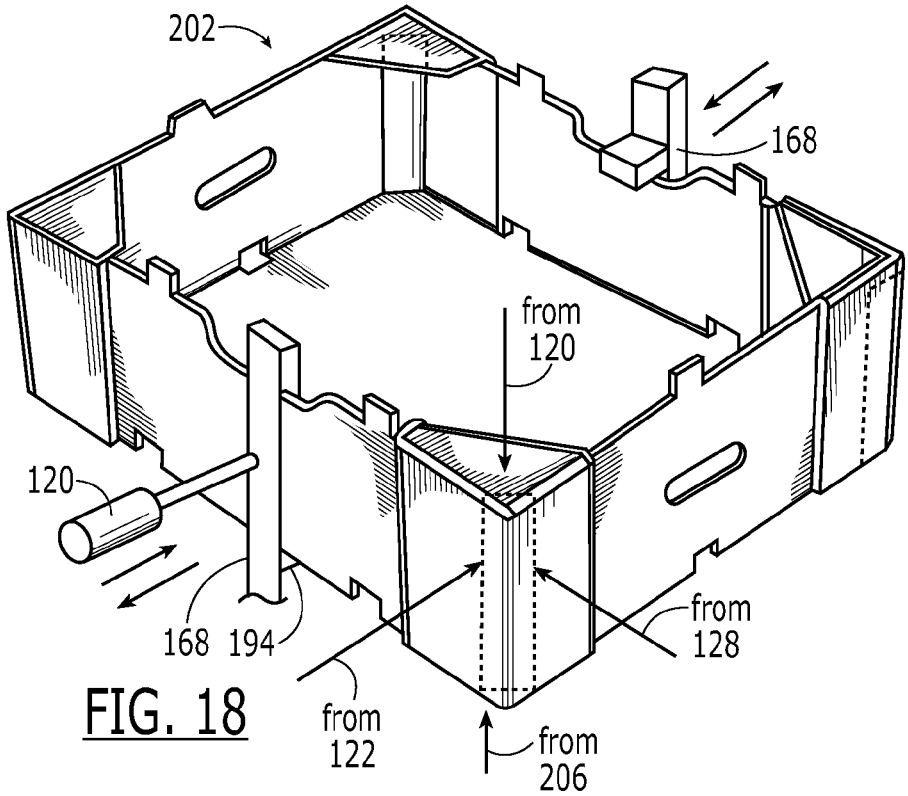
FIG. 18 is a top front perspective view of a fully formed tray formed by the apparatus of FIGS. 1-3.

With reference to FIGS. 12-15, a forming of the outside corner support members 238 commences with the second folding arm 128 rotated against the end fold portions 244, folding them about the sixth fold lines 240, and biasing the end fold portions against the end panels 212. As illustrated with reference to FIG. 12, by way of example, an edge 245 of the end fold portion 244 is guided onto the end panel 212 along a surface 125 of the fixed plate 124 for orienting the end fold portion 244 in a preferred orthogonal relation to the bottom panel 210 for enhancing the load bearing strength of the tray 202, as earlier described. A final compression phase includes the compression plate 122 folding of the partially folded side fold portion 246 and compressing thereof as illustrated with reference to FIGS. 16-18. Compression forces act upon each corner of the fully formed tray 202 with the compression plate, the first and second folding arms, and the locking arm each providing opposing forces to compress the adhesive against respective tray surfaces, as further illustrated with reference to FIG. 19 including a partial top view of the double glued wall construction. As will be understood by those skilled in the art, the controller 148 earlier described with reference to FIG. 1, a controller is operable with drive devices for each of the platen drive, the compression plate, the first folding arm, the second folding arm, and the locking mechanism for a timely movement thereof. With such, the fully formed tray 202 may be released from the frame 112. As illustrated with reference again to FIG. 2, a glue-setting phase may be provided as herein described, by way of example, with reference to a magazine styled frame 172 which receives the fully formed tray 202 stops 174, such as that of the locking arm 168 are released to permit a subsequent tray being formed to push the fully formed and glued tray into the magazine styled frame 172. The magazine styled frame 172 includes framing elements 176 that form an aperture for receiving the tray having an increased outside dimension as a result of the folded corner construction.

As illustrated with reference again to FIG. 2, the apparatus 100 herein described by way of example, carries three trays within the apparatus with a first tray, a partially formed tray 206, illustrated with reference again to FIG. 3 in the forming phase followed by the compression phase, a second tray 203 being held in the magazine styled frame section for glue setting, as illustrated with reference again to FIG. 2, and a third tray, fully formed tray 202 ready to be ejected when another blank is pushed into position for forming into the partially formed tray 206. A conveyor 178 may then be used to received the fully formed trays 202 for movement to an appropriate loading area, by way of example.

Figure 20:
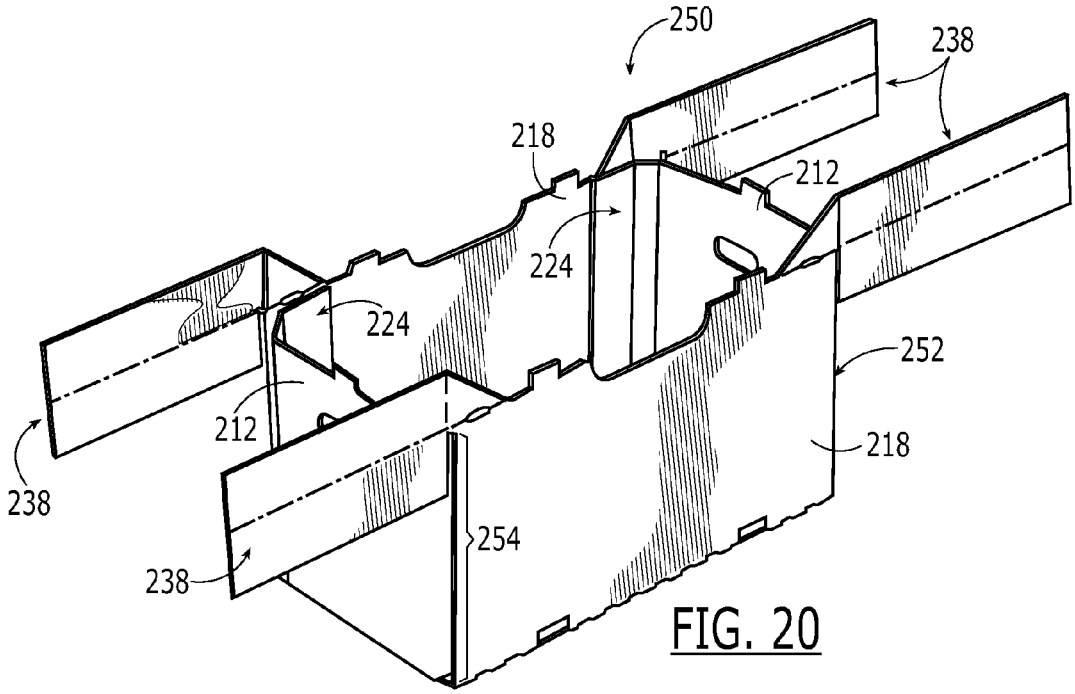
FIG. 20 is a perspective view of a partially formed deep walled container illustrating one container structure to be formed by an alternate embodiment of the invention.
Figure 21:
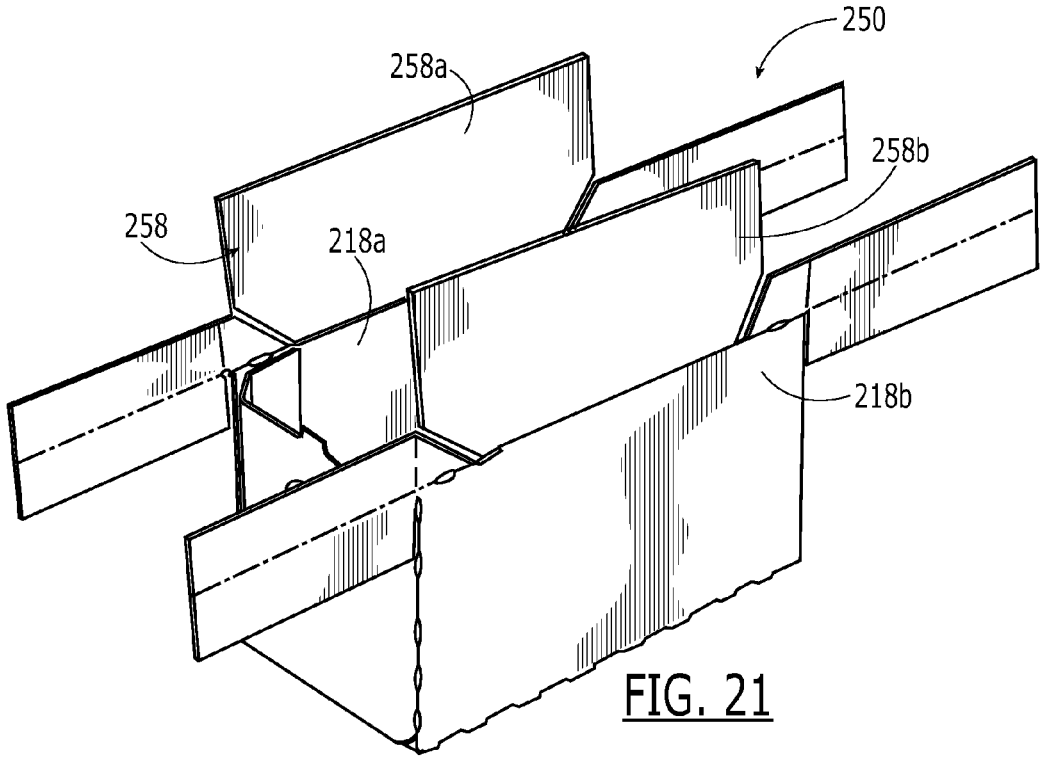
FIG. 21 is a perspective view of a partially formed deep walled container having a lid formed thereon illustrating a container structure to be formed by an alternate embodiment of the invention.

With reference now to FIG. 20, and as above discussed, there is a need to efficiently form a container 250 that unlike trays 202 typically used to carry produce such as fruit and the like, may have relatively deep side walls 252, and further may be formed from a lighter weight paperboard than that generally used for trays. While the blank 200 earlier described with reference to FIG. 8 will generally be used, specific panel dimensions will change. By way of the example herein described, the panels forming the side walls 252 of the container 250 will have a longer depth dimension 254 that the depth dimension 256 for the tray 202 illustrated with reference again to FIG. 5. An improvement to the above described apparatus 100, herein described, accommodates the requirements for forming the deeper tray or container 250. Because the increased tray height (depth) 254 also adds to the travel stroke of the platen 102 to complete the folding, cycle time of the platen 102 for the above described apparatus 100 would have to be increased. As illustrated with reference to FIG. 21, such a requirement may be further demanding when the container 250 also includes a lid 258 having one portion 258*a* of the lid attached to one side panel 218*a* and a second portion 258*b* of the lid attached to an opposing side panel 218. One improvement to the apparatus 100 includes mechanically powering the initial folding of the blank 200 using the forming rails earlier described but now powering selected forming rails for to fold portions of the blank prior to the platen being biased against the blank including a folding up of "end flaps" that provide the inside corner support member 224 and thereafter folding the end panels 212 to assist the platen 102. As described in greater detail below, these two steps happen prior to and in conjunction with the platen 102 being engaged to move thru the folding area. This takes about 33% out of the platen stroke needed to typically make the initial folds earlier as was earlier described.

Figure 19:
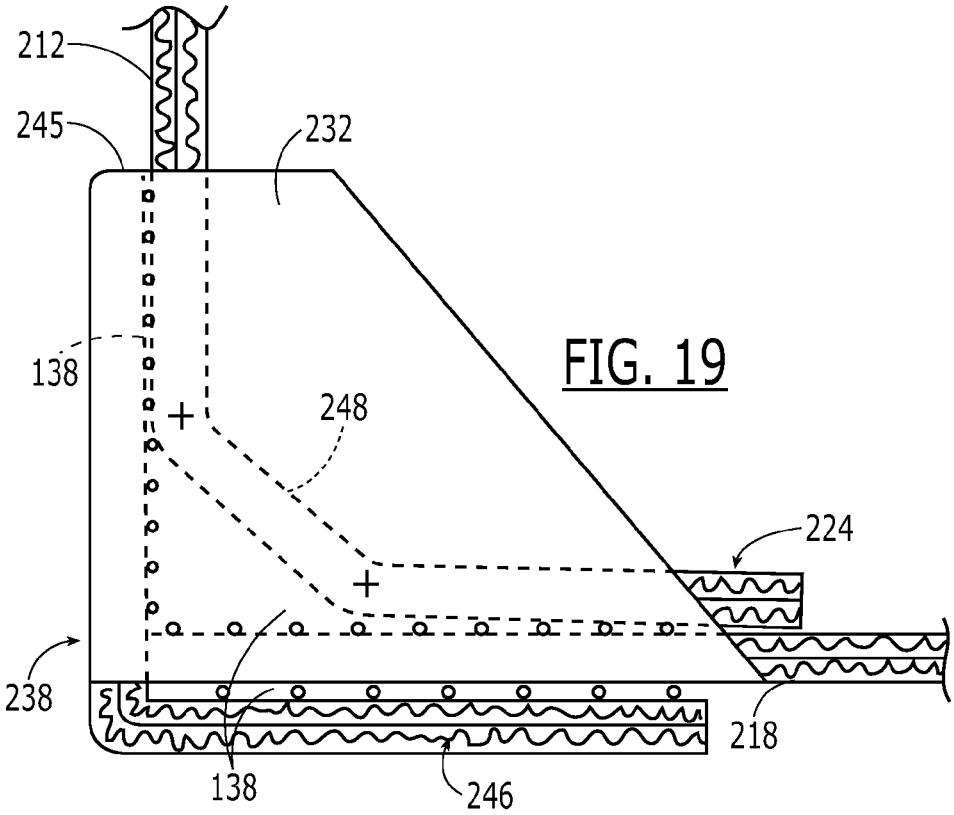
FIG. 19 is a partial enlarged top plan view of one corner portion of the fully formed tray of FIG. 18.

With reference again to FIGS. 2 and 3, illustrating the apparatus 100 for forming the tray 202 having the double glued corner structure above and described with reference to FIG. 19, by way of example, an improvement to this apparatus 100 is now described, by way of example, as being useful and in efficiently forming the deep walled container 250 from the generally flat paperboard blank 200, as earlier described, but now having alternate dimensions such as the depth dimension 254 described with reference to FIG. 20. As earlier described, the blank 200 includes a plurality of scored fold lines 216, 222, 228, 230, 236, 240, and 242 for defining the bottom panel 210, opposing end panels 212, each having opposing edge portions 226, 224, and opposing side panels 218.

Figure 2:
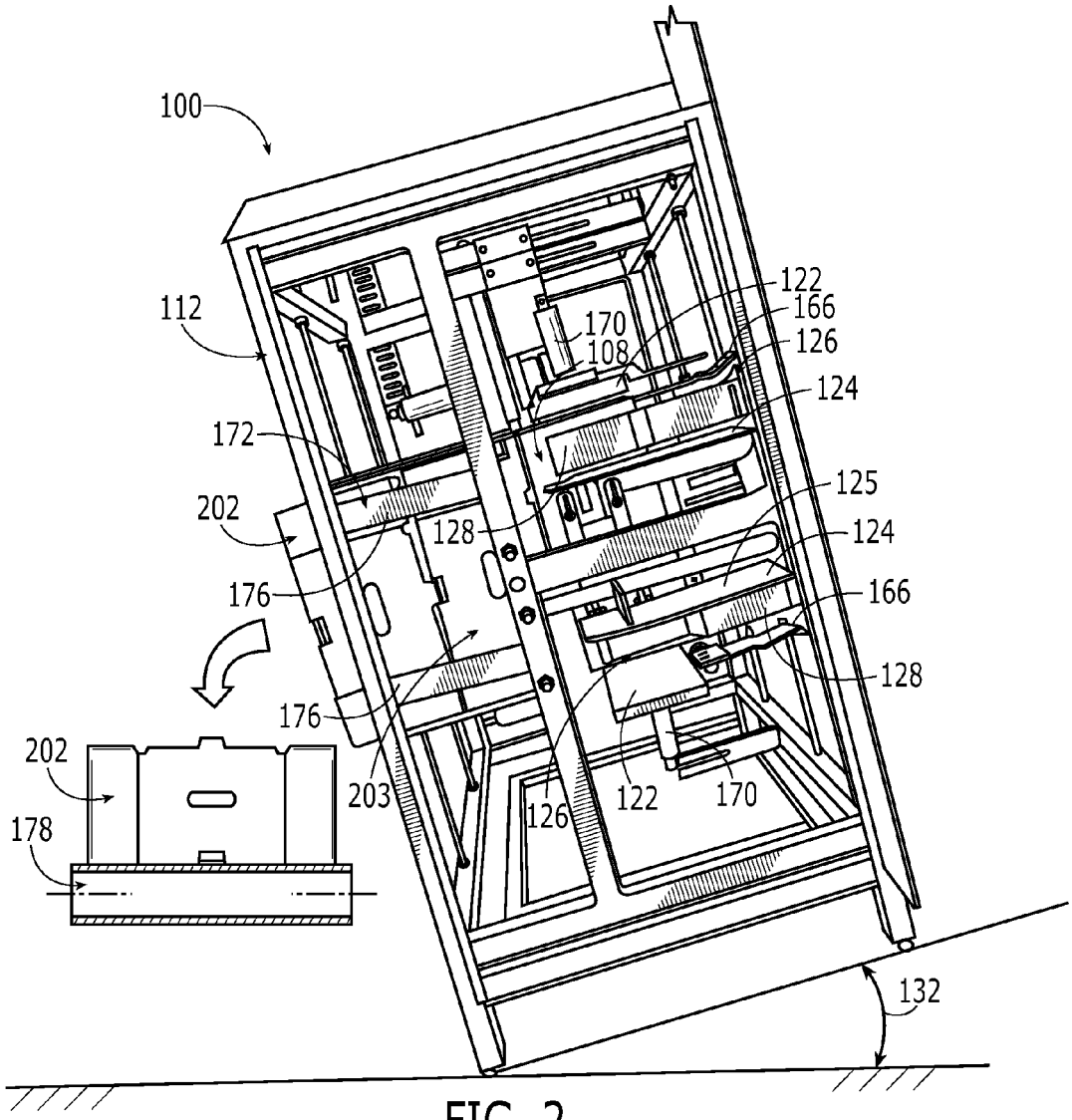
FIG. 2 is a partial side elevation view of the apparatus of FIG. 1.
Figure 22:
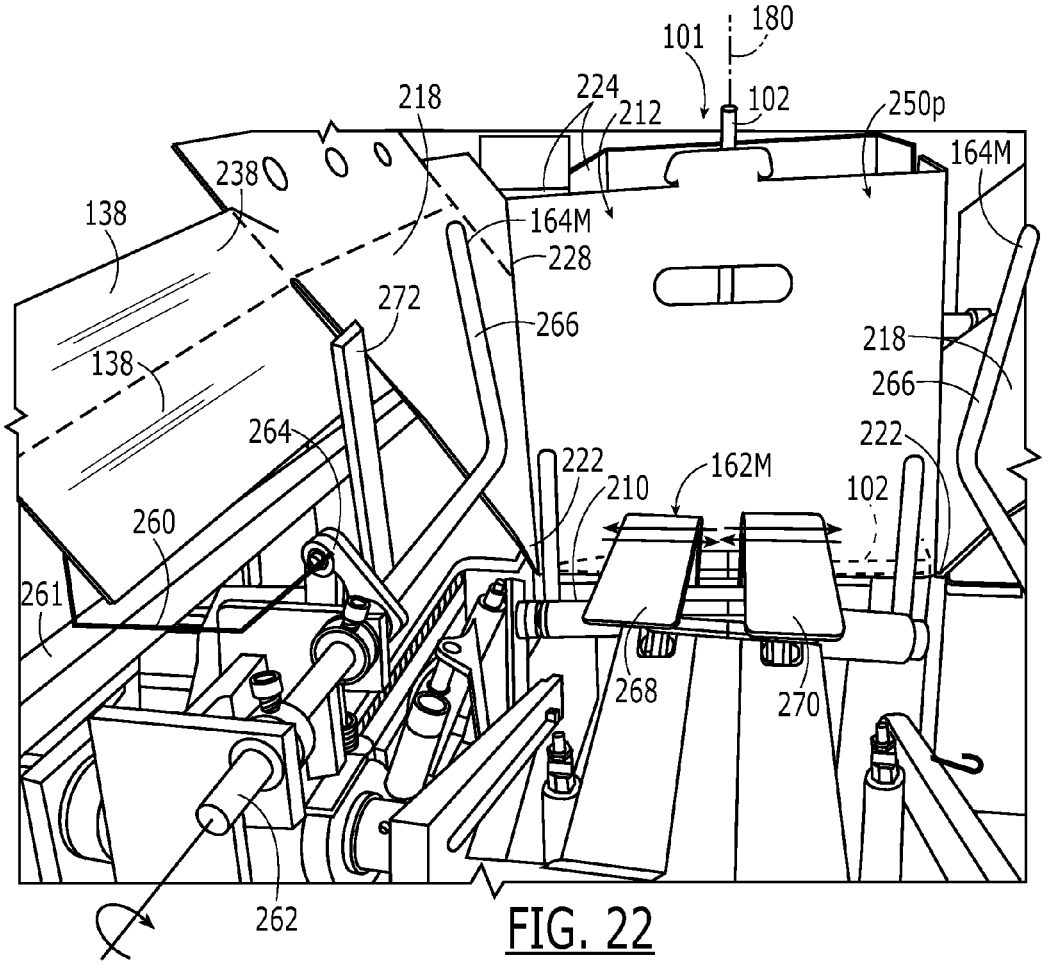
FIG. 22 is a partial perspective view of an alternate embodiment of the invention useful in forming deep walled containers as illustrated in FIG. 20.

With continued reference to FIGS. 2 and 3, and to FIG. 22, the apparatus 101 is herein described as including the platen 102 movable between the first position 106 and the second position 108 along a path 180. The platen 102 is operable for biasing against the blank 200 positioned within the path 180 for driving the blank downstream the first position 106 toward the second position 108. With a comparison to the apparatus 100 having the opposing edge rails 164 and opposing end folding rails 162 fixed relative to the frame 112, the apparatus 101 is modified to include rotatable and powered rails 164*m*, 162*m*, as illustrated with continued reference to FIG. 22 and to FIG. 23. By way of illustration with continued reference to FIG. 23, the blank 201, herein used to form the container 250, is shown after being conveyed along longitudinal path 182 and placed in a position to allow the platen 102. First and second opposing edge rail pairs 164*m* are mechanically operable for inwardly folding outside edge portions, herein referred to as outside corner supports 224 of the end panels 212 of the blank 201, as illustrated with reference to FIG. 24. At an initial forming stage illustrated in FIG. 23, the platen 102 is in the first position 106.

The opposing first and second end folding rails 162*m* are mechanically operable and positioned for receiving the end panels 212 and folding the end panels upwardly from the bottom panel 210, as illustrated with reference to FIG. 24. The platen 102 may begin to move from the first position 106 downstream along the path 180. The inside corner support members 224 at the outside edge portions the end panel 212 are now upwardly folded. The opposing end folding rails 162*m* now fold end panels 212 upwardly, as illustrated with reference to FIG. 25. By operating the apparatus 101 in such a manner as to allow the platen 102 to move downstream the first position, as illustrated with reference again to FIG. 22, the opposing first and second side folding rails 166 carried in a fixed position relative to and operable with the platen 102 for receiving the opposing side panels 218 and folding the side panels 218 upwardly from the bottom panel 210, the opposing side panels 218 capture the inside corner support members 224 and hold them in a folded position until the plate 102 is moved further downstream toward the second position and more fully formed into the container 250 as earlier described for the forming of the tray 202 by the apparatus 100.

With continued reference to FIG. 22, the bottom panel 210 of the partially formed container has been moved downstream from its initial loading position and is shown to be below the plane 260 of the initial loading position. Further, as herein illustrated by way of example, the mechanically operated opposing edge rails 164*m* comprise a shaft 262 rotatably driven by a mechanical linkage 264 for rotating the shaft. A folding arm 266 is formed with the shaft so as to perform the folding function above described. The opposing end folding rails 162*m*, herein described may comprise first and second plates 268, 270 that are moveably adjustable to accommodate varying width end panels 212. As the side panels 218 are being folded upwardly about the second fold line 222, the rotating action of the side panels may cause the associates outside corner support members 238 to rotate about the sixth fold line 240 causing the adhesive 138 to be undesirably moved through a whipping action of the members 238. With continued reference to FIG. 22, and again to FIGS. 22-25, a guide element 272 may be attached to the shaft 262 to reduce the amount of whipping and thus reduce the undesired distribution of the adhesive 138. The guide element 272 is thus rotated with the folding arm 266 for an appropriate positioning during the folding of the blank 201. In addition, the guide element allows adhesive to be desirably applied closer to edges of the blank.

Figure 23:
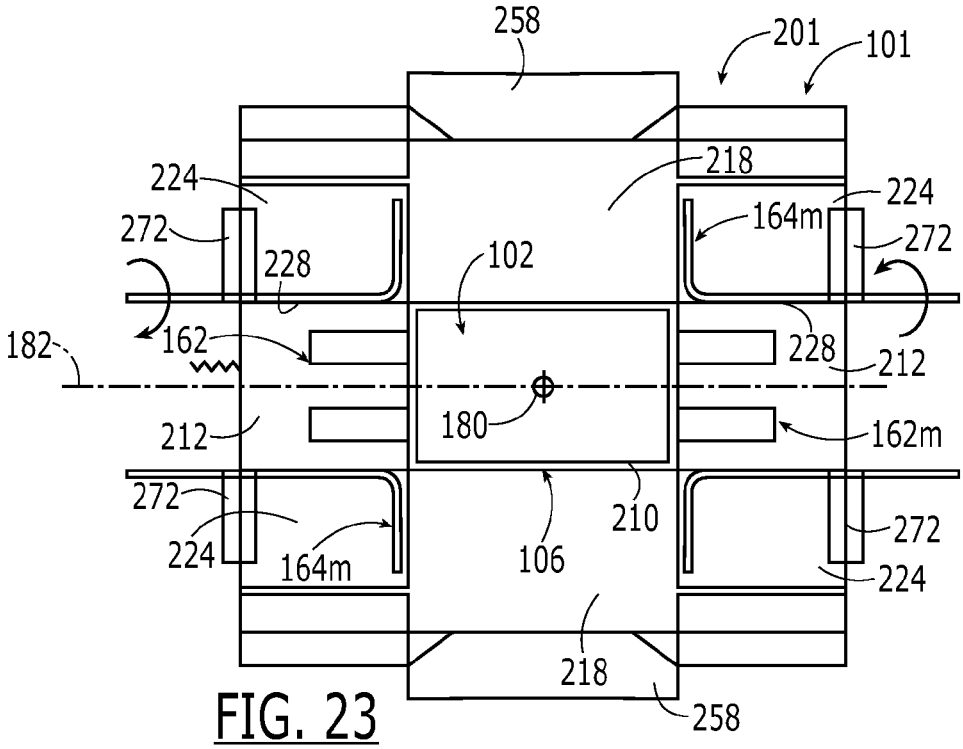
FIGS. 23-25 are partial plan views of the apparatus of FIG. 22 illustrating steps in the forming of the container of FIG. 20.
Figure 24:
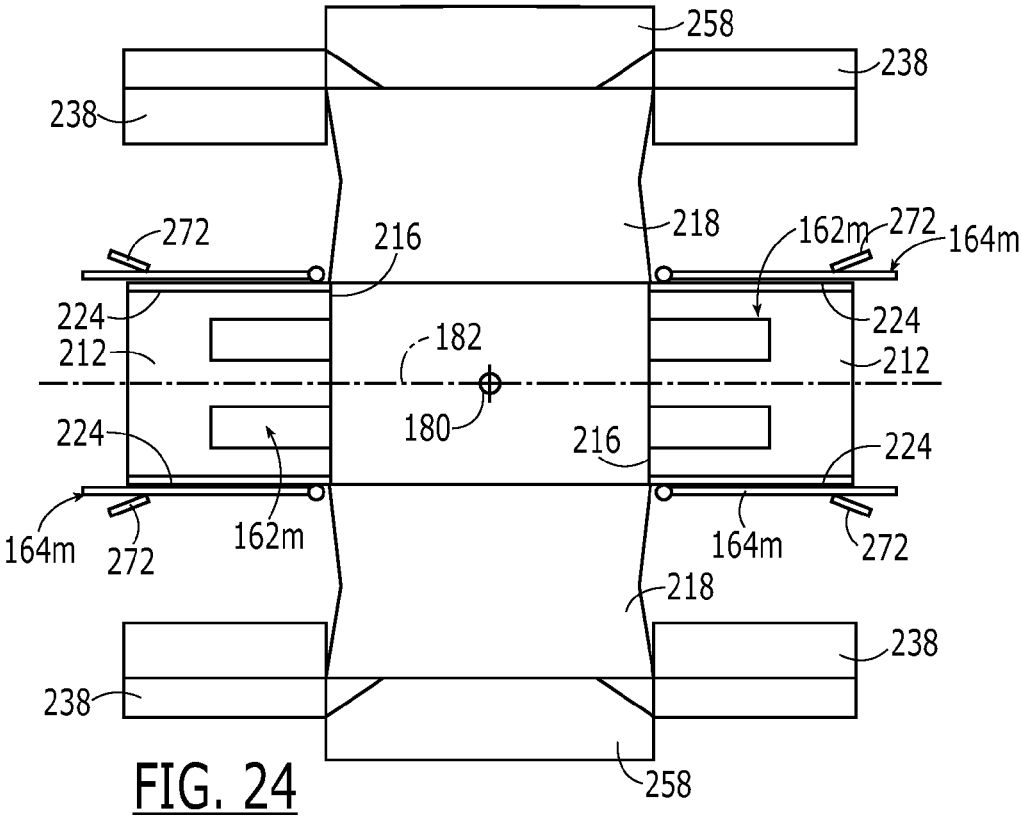
Figure 25:
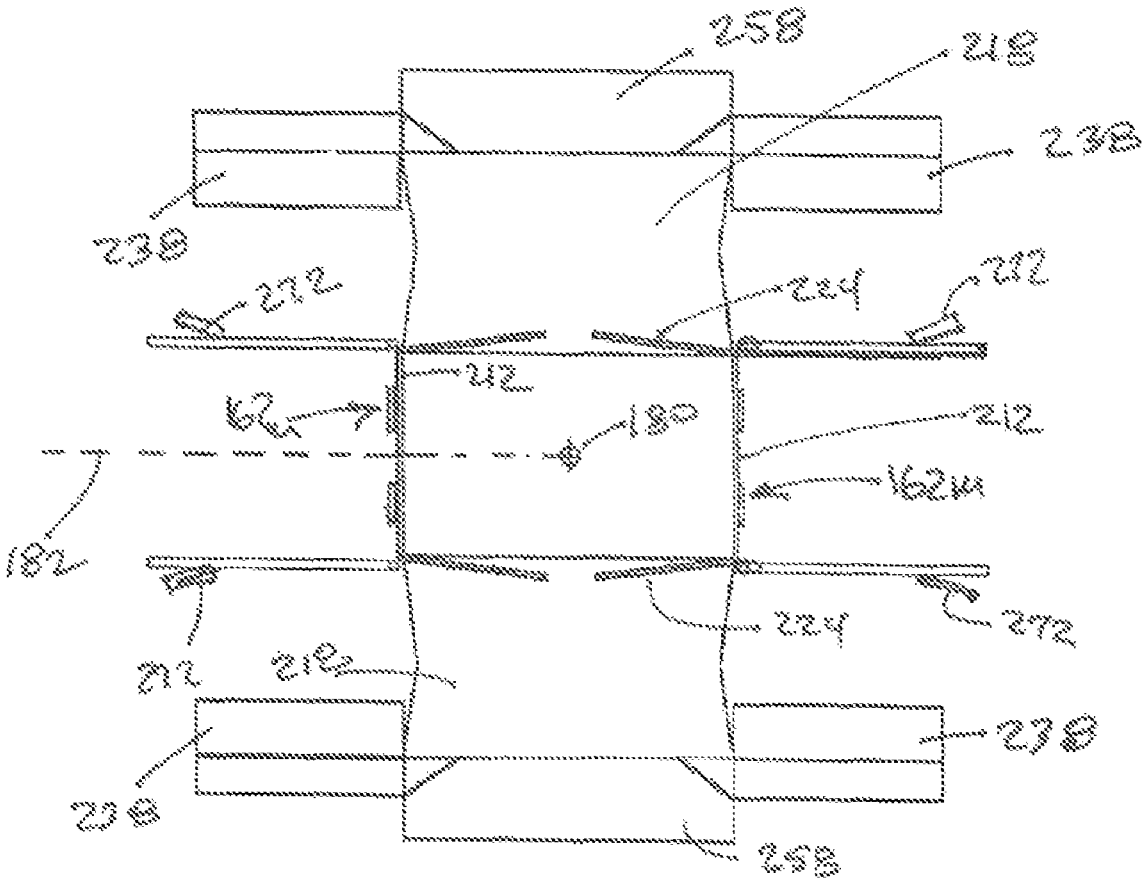
Figure 25:
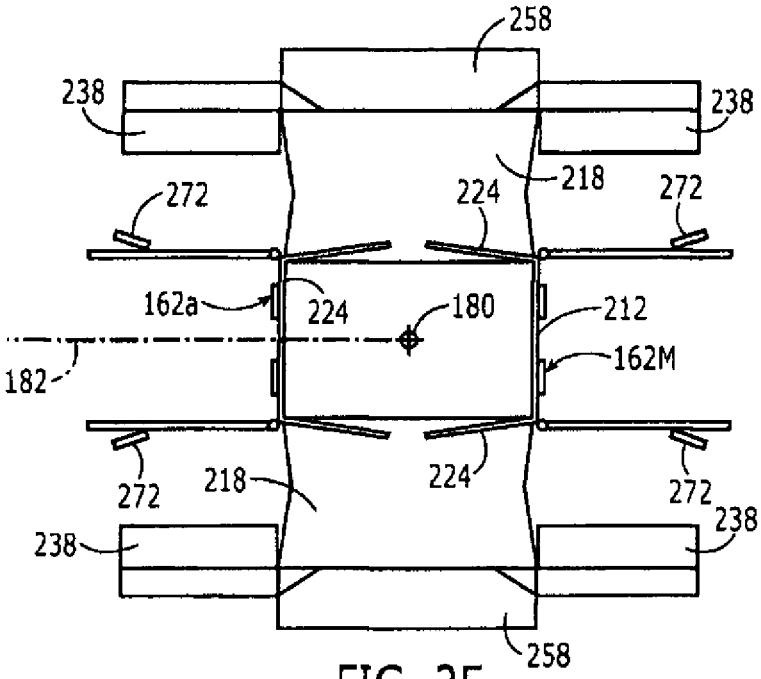

It should be noted that the blank and forming elements illustrated with reference to FIGS. 23-25 are shown with solid lines rather than dashed line for hidden elements. Such is presented in the interest of illustration and clarity of viewing elements.

Figure 22A:
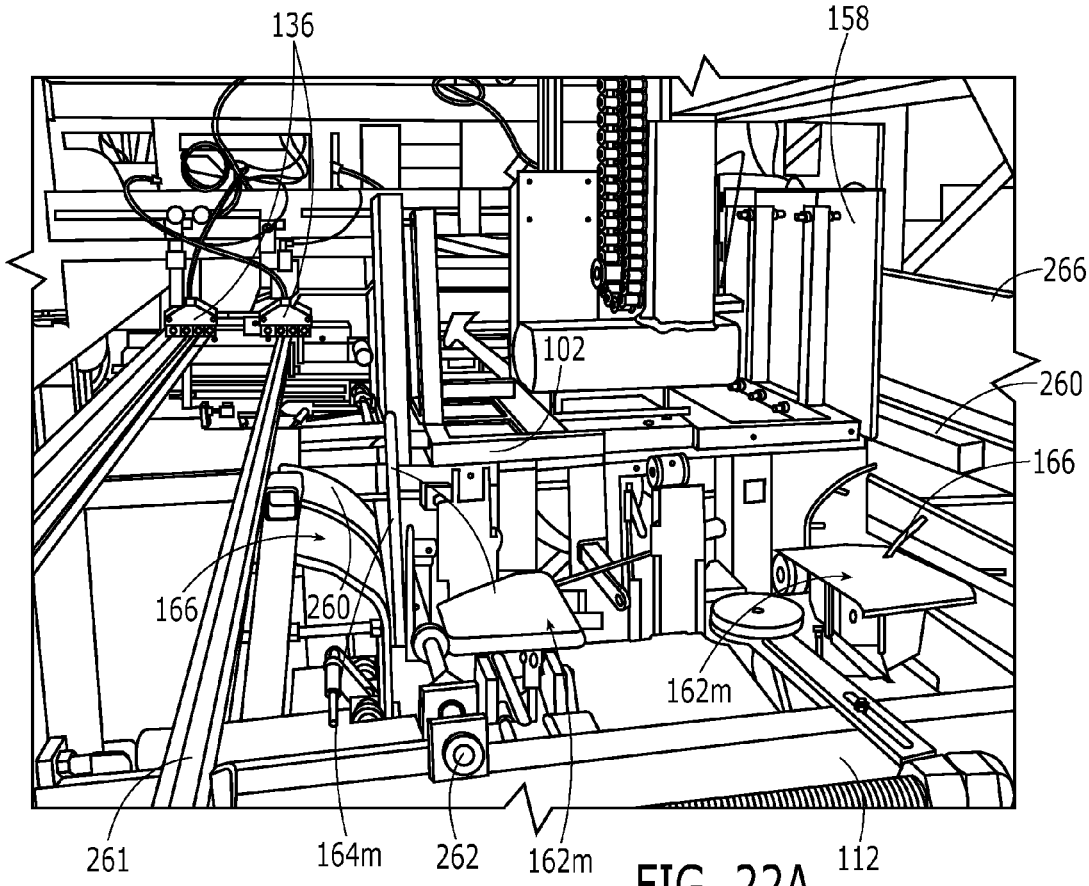
FIG. 22A is a partial perspective view of the embodiment illustrated with reference to FIG. 22 without the partially formed container.

To further illustrate operation of the apparatus 101 with reference again to FIGS. 23-25, by way of example, a method of forming the container 250 from the paperboard blank 201 may be described as positioning the blank 201 at the first forming position 106 wherein the platen 102 is supported in a spaced relation above the blank. As earlier described, the platen 102 is dimensioned and aligned to fit proximate the first and second fold lines 216, 222 when contacting the bottom panel 210. With the blank 201 positioned as illustrated with reference to FIG. 23, the first and second opposing edge rail pairs 164*m* are operated to fold the inside corner support members 224 upwardly about the third fold lines 228 at the end panels 212. The opposing first and second mechanically operable end folding rails 162*m* fold the opposing end panels 212 upwardly from the bottom panel 210 along the first folding lines 216, moving the end panels from a horizontal orientation to a vertical orientation, as illustrated in FIGS. 24 and 25. As the end panels 212 are being brought to the vertical position, the platen 102 is moving downstream toward the second position to move the bottom panel 210 to a location below the plane 260 from which it started, as illustrated with reference to FIGS. 22 and 22A. As illustrated with reference to FIG. 22A, a track is provided by the conveyor belts 261 are carried on the plane 260 for moving the blank along the horizontal plane into position for being contacted by the platen 102. For the embodiment herein presented by way of example, the plane 260 is established by a top surface of square tubing, which tubing starts the folding of the opposing side panels 218 prior to be folded by the opposing side folding rails 166 through the movement of the platen 102. The movement of the platen 102 causes the opposing side panels 218 to be upwardly folded about the second folding lines 222 by the first and second side folding rails 166 carried in a fixed position relative to and operable with the platen 102. The biasing the platen 102 against the bottom panel 210 of the blank 201 for advancing the blank to create a partially formed container 250*p* downstream the first forming position 106 folds the side panels 218 upwardly from the bottom panel 210 along the second folding lines 222 sufficient for allowing the opposing side panels 218 to secure the inside corner support members 224 in a folded position biased against inside surfaces of the side panels 218, as illustrated with reference again to FIG. 22.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the claims herein presented.

That which is claimed is:

1. A method of forming a container from a paperboard blank, the method comprising:

providing a generally flat paperboard blank having a plurality of fold lines therein for defining a bottom panel, opposing end panels attached to the bottom panel via first fold lines, opposing side panels attached to the bottom panel via second fold lines, wherein each of the opposing end panels includes opposing outside edge portions for forming an inside corner support member, wherein each of the opposing outside edge portions are attached to opposing edges of the end panels via a third fold line;

positioning the blank at a first forming position;

supporting a platen proximate the first folding position in spaced relation to the blank, the platen dimensioned and aligned to fit proximate the first and second fold lines when contacting the bottom panel;

providing first and second opposing edge rail pairs mechanically operable and positioned for folding the outside edge portions of the end panels;

mechanically operating the first and second opposing edge rail pairs for folding the outside edge portions of the end panels along the third folding lines of the blank;

providing opposing first and second mechanically operable end folding rails positioned for receiving the end panels of the blank;

mechanically operating the opposing first and second end folding rails for folding the end panels upwardly from the bottom panel along the first folding lines, the outside edge portions of the end panel already being inwardly folded;

providing opposing first and second side folding rails carried in a fixed position relative to and operable with the platen for receiving the opposing side panels through an action of moving the platen downstream from the first forming position; and biasing the platen against the bottom panel of the blank for advancing the blank downstream the first forming position for folding the opposing side panels upwardly from the bottom panel along the second folding lines, wherein an initial movement of the platen is sufficient for securing the outside edge portions of the end panels in a folded position through a biasing of the opposing side panels thereagainst, thus initially securing the outside edge portions of the end panels in the folded position prior to a further advancing of the platen further downstream.

2. A method according to claim 1, further comprising advancing the platen downstream and thus the blank along the path to the second forming position, wherein a forming rail secures the blank into a partially formed container, wherein the partially formed container is configured with the end and side panels positioned generally orthogonal to the bottom panel and each of the inside corner support members is folded about the third fold line and in juxtaposition with the side panel portions having adhesive thereon, and wherein each of the top wall portions and outside corner support members are generally parallel to respective side panels thereof.

3. A method according to claim 2, further comprising retracting the platen from the second forming position upstream along the forming path to the first position.

4. A method according to claim 3, further comprising biasing a first folding arm against the top wall portion for folding the top wall portion about a fifth fold line, the fifth fold line attaching the top wall portion to an edge of the side panel, the top wall portion being folded to a position generally parallel to the bottom panel, wherein the outside corner support member is partially folded about a seventh fold line within the outside corner support member, the seventh fold line forming an end fold portion foldable about a side fold portion, and wherein the side fold portion is partially folded about the seventh fold line by contacting a plate.

5. A method according to claim 4, further comprising:

biasing a second folding arm against each of the end fold portions for a folding thereof about a sixth fold line, the sixth fold line folding end fold portions of the outside corner support member about a fold line attaching outside corner support member to the top wall portion, the second folding arm folding the end fold portion into contact with the end wall; and compressing each of the side fold portions against the side walls for forming a fully formed container having double glued corner portions formed from the sandwiching of the side panel between the side fold portion of the outside corner support member and the inside corner support member.

6. A method according to claim 1, wherein the steps from providing first and second opposing edge rail pairs through mechanically operating the opposing first and second end folding rails takes place prior to the platen biasing step.

7. A method according to claim 1, wherein the steps from providing first and second opposing edge rail pairs through mechanically operating the opposing first and second end folding rails takes place with the platen biasing step.

8. A method according to claim 4, wherein the platen retracting step takes place prior to the first folding arm biasing step.

9. A method according to claim 5, wherein the platen retracting step takes place prior to the second folding arm biasing step.

* * * * *

UNITED STATES PATENT AND TRADEMARK OFFICE

CERTIFICATE OF CORRECTION

PATENT NO. : 7,470,226 B1
APPLICATION NO. : 11/467312
DATED : December 30, 2008
INVENTOR(S) : Robert M. Herrin It is certified that error appears in the above-identified patent and that said Letters Patent is hereby corrected as shown below:

Delete drawings sheet 15 of 15 and substitute therefor the drawing sheet, consisting of fig. 25 as shown on the attached page.

Signed and Sealed this

Seventh Day of July, 2009

John Doll

JOHN DOLL
*Acting Director of the United States Patent and Trademark Office*